United States Patent [19]

Gunn

[11] 4,266,594

[45] May 12, 1981

[54] SAFETY STORM WINDOW

[76] Inventor: Robert D. Gunn, 1471 Akins Rd., Broadview Heights, Ohio 44141

[21] Appl. No.: 82,968

[22] Filed: Oct. 9, 1979

[51] Int. Cl.[3] ..... A47H 23/00

[52] U.S. Cl. ..... 160/354; 49/56; 160/368 R

[58] Field of Search ..... 160/40, 105, 230, 231 A, 160/354, 368 R, 369; 49/56, 464, 465

[56] References Cited

U.S. PATENT DOCUMENTS

| | | | |
|---|---|---|---|
| 550,995 | 12/1895 | Mueller | 49/465 |
| 732,693 | 7/1903 | Adams | 160/105 |
| 882,014 | 3/1908 | Neale | 49/464 |
| 909,111 | 1/1909 | Paulson | 49/464 |
| 2,318,217 | 5/1943 | Goldmerstein | 160/40 |
| 2,320,125 | 5/1943 | Goldmerstein | 160/40 |
| 2,402,112 | 6/1946 | Gee | 49/464 |
| 3,009,169 | 11/1961 | Bodner | 160/231 A |
| 3,019,486 | 2/1962 | Stinson | 160/231 A |
| 3,083,630 | 4/1963 | Thaxton | 160/105 |
| 3,921,334 | 11/1975 | Black, Sr. | 49/56 |

*Primary Examiner*—Peter M. Caun
*Attorney, Agent, or Firm*—Harold S. Meyer

[57] ABSTRACT

A storm window is made of two or more panes of non-shatterable plastic hinged together so that the window can be reduced in one dimension sufficiently to permit the edges to enter permanent channels in the frame. The panes are straightened and held in a plane position by latches operated from the inside.

10 Claims, 15 Drawing Figures

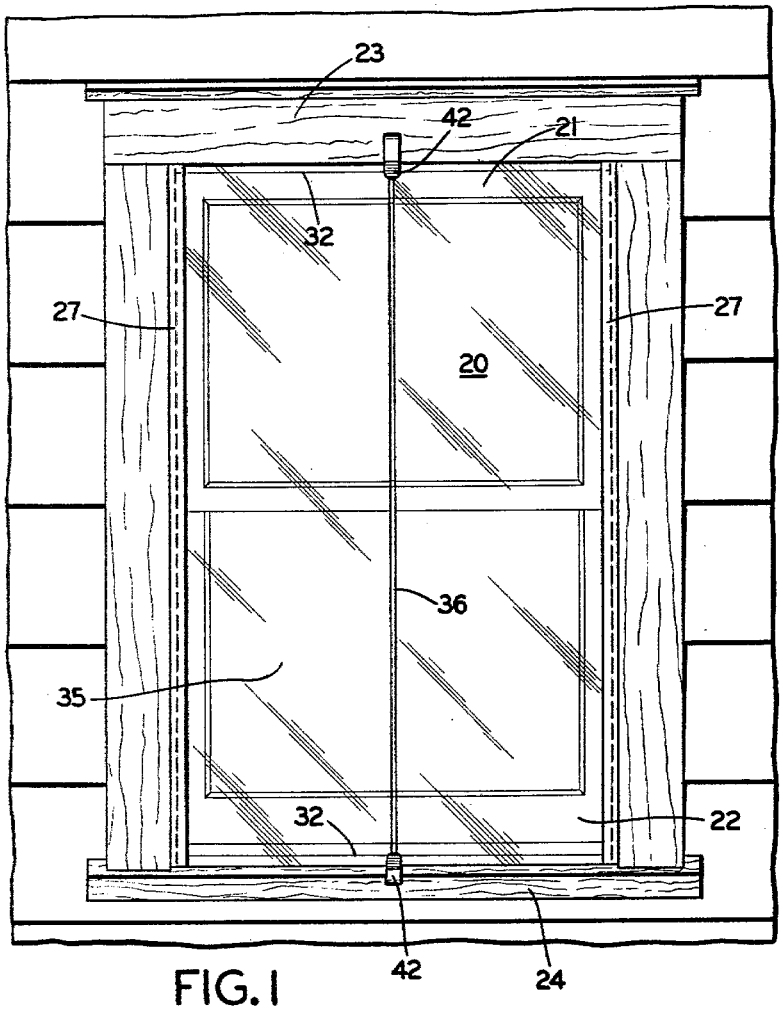
FIG. 1
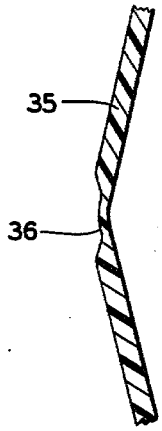
FIG. 3
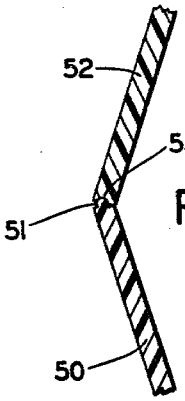
FIG. 4
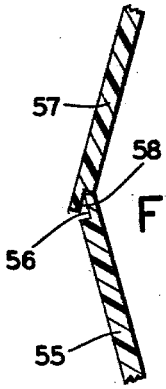
FIG. 5
FIG. 2
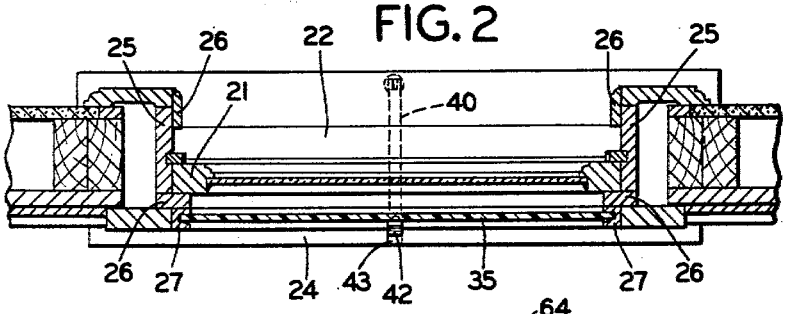
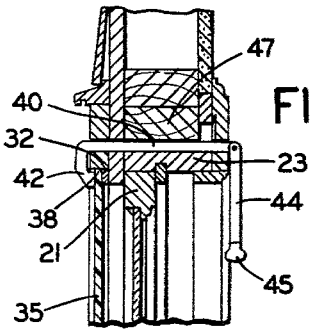
FIG. 13
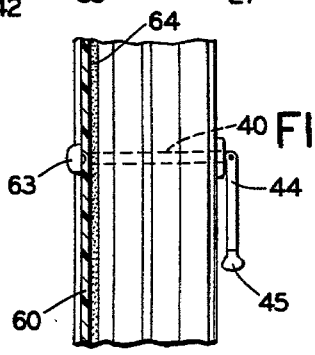
FIG. 14
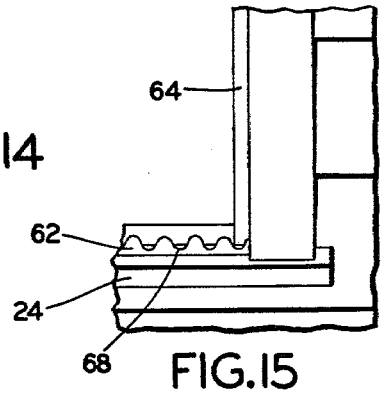
FIG. 15

SAFETY STORM WINDOW

BACKGROUND

Storm windows have the essential function of providing a secondary barrier against transmission of heat between the inside and outside of a window. They have generally consisted of a glass or plastic pane mounted in a frame fitting in the window opening, with a narrow space separating the storm window from the permanent window. Such storm windows, if provided with inside fastenings, can provide additional safety against unauthorized entry, along with their primary function of reducing the flow of heat.

Storm windows in general have been heavy and awkward to manage because of the necessary presence of a frame, and have not always performed their intended functions adequately because of the difficulty of providing a satisfactory seal against flow of air inward or outward past the storm window.

OBJECT OF THE INVENTION

The object of this invention is to provide a superior kind of storm window which is light in weight and easily handled for application or removal, and which results in a window assembly which eliminates drafts and is inexpensive, attractive in appearance, and essentially burglar-proof.

SUMMARY OF THE INVENTION

These objects and benefits are accomplished, in accordance with this invention, by providing a storm pane which can be flexed to reduce one dimension to permit placing it in a window opening having seals facing toward one another in that dimension, so that straightening of the flexed pane will cause two of its edges to bear against the seals.

The other two edges are then pressed horizontally inwardly of the window opening, against seals facing the outside of the window, and are fastened with latches or other means for holding the pane, in its flattened condition, against those seals.

The storm pane is preferably made with a hinge line permitting local bending through a small angle sufficient to draw two opposite edges together and release them from the edge seals for removal of the pane. The same action in reverse is carried out for application of the storm panes.

The latches are preferably of a type operable only from the inside so that an unauthorized person on the outside cannot open the window. Preferably, also, the storm pane is made of a shatter-proof organic plastic material so that it will be durable and will offer substantial resistance to unauthorized entry. Such a material will also reduce heat loss by transmission through the pane, as compared to glass.

The storm panes are preferably made of a slightly flexible material, suitably one of the common transparent plastics which are stiff and only slightly yielding when about the normal thickness of a window-pane, from about 2 to 5 mm (roughly 3/32 to 7/32 inch) thickness, but can be bent repeatedly when thinner, from about 1 mm or somewhat less to about 2 mm (roughly 1/32 to 3/32 inch). Of course, if transparency is not needed or not desired, a milky or completely opaque material can be used to make the storm panes.

The special characteristics of the storm panes used in this invention is that they must either be hinged along a transverse line, or be capable of a moderate degree of flexing, so that they can be bowed in one dimension to permit opposing edges to enter the opposing channels mentioned above, and then be straightened so as to prevent the edges from coming out of the channels, and also so as to bring the remaining two edges of the pane into sealing contact with the uniplanar surfaces of the remaining two edges of the window opening.

Suitable fittings are provided for holding the pane in contact with all four edges of the window opening. Such fittings are preferably operated from within the window, to provide maximum security combined with convenience in use.

THE DRAWINGS

In the accompanying drawings:

FIG. 1 is an elevation of a storm window of this invention, mounted outside of double hung sash.

FIG. 2 is a sectional plan view of FIG. 1.

FIG. 3 is a partial horizontal section, on a larger scale, showing the mid-portion of a storm pane useful in the assembly of FIGS. 1 and 2, with a thinned zone functioning as a hinge.

FIG. 4 is a similar horizontal section of the mid-portion of an alternative form of pane with a tongue and groove hinged joint.

FIG. 5 is another horizontal section of the mid-portion of a pane with a ship-lap joint.

FIG. 13 is a vertical section on a smaller scale showing a similar latch at the top of the window cooperating with the bottom latch of FIGS. 11 and 12.

FIG. 14 is a view of a window jamb from the center of the window opening, showing a latch engaging a storm pane having a horizontal hinge line, and FIG. 15 shows the horizontal bottom seal.

DETAILED DESCRIPTION

Figure 6:
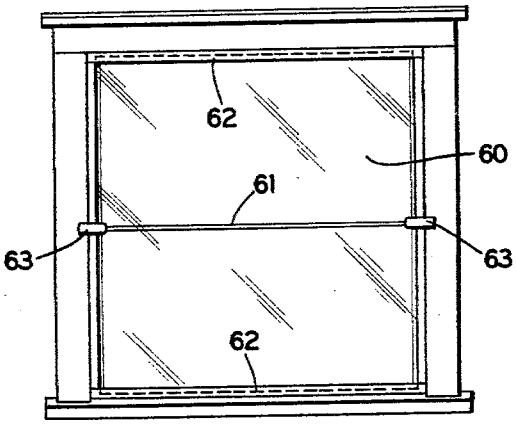
FIG. 6 is an elevation, on a smaller scale, of a modified storm window with the hinge horizontal rather than vertical.

Referring to FIGS. 1 and 2, this invention can be added to almost any conventional rectangular window, such as a window opening 20 containing ordinary double hung sliding sash, namely, upper sash 21 and lower sash 22 sliding vertically in a frame consisting of lintel 23 and sill 24 joined by vertical jambs 25,25 (FIG. 2) within which the double hung sash can be moved vertically between inner and outer rails 26,26 for opening and closing the window.

Figure 10:
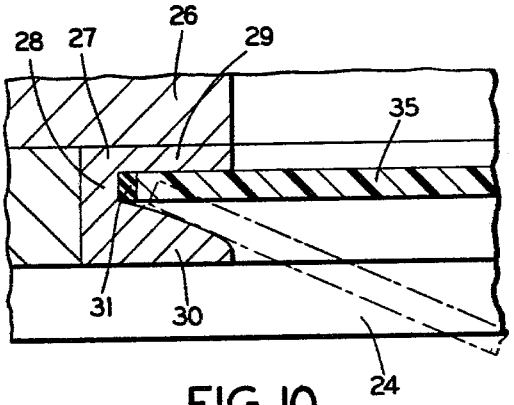
FIG. 10 is a full size sectional plan view of a preferred form of edge seal.

In accordance with this invention, in a preferred embodiment, two facing vertical channel strips 27,27 are permanently fastened to the two window jambs. In a double hung window, as shown, the channels may be in snug engagement with the outer guides 26 on each side. Each channel, as shown in FIG. 10, consists of a web 28 joining a flat inner flange 29 and a flared outer flange 30. Preferably a sealing strip 31 is permanently fixed in the base of the groove of the channel. The sealing strip may be felt, but is preferably a non-absorbent compressible material such as rubber tubing or closed-cell elastic foam.

Figure 12:
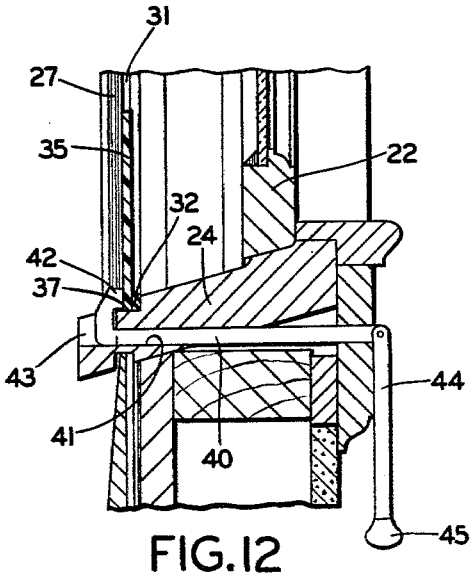
FIG. 12 shows the closed position of the latch.

Another similar sealing strip 32 is fastened to the sill 24, as shown in FIG. 12, to seal the inner face of the bottom edge of the storm pane 35, and extends horizontally outward somewhat beyond the inner flanges 29 of channels 27. An additional seal of the same kind is fastened to the lintel 23, as shown in FIG. 13, for sealing the top edge of pane 35, so that a wind tight seal will be obtained around the entire periphery of pane 35.

Since the seals can easily be made from a weatherproof and non-absorbent resilient material, they can be permanently mounted and be left in place the year around, whether the storm pane is present or not.

In some situations it may be desirable to immobilize the storm sash by using a tubular seal in the channel strips 27, and after installation of the pane 35, injecting a settable fluid into each tube, which would offer greater security without preventing normal opening when required.

The actual storm pane 35 of this invention is preferably made of a hard, transparent, slightly flexible, plastic material, of a thickness to make it essentially rigid under normal conditions of use, but of such a combination of elasticity and thickness and structure that it can be bent sufficiently to bring the edges toward one another by a small distance, at least equal to the depth, or preferably twice the depth of the groove of channels 27,27.

There are many transparent plastics having the slight resilience desirable for use in this invention, such as cellulose esters, poly-acrylic esters, polymers and copolymers of vinyl chloride, reaction products of phenol or resorcinol with aldehydes, and more kinds are constantly being made available. The flexibility for making them conform adequately, and be essentially shatterproof, is adjustable by various known means, as by copolymerization or by adding elastomers or plasticizers. Accordingly, this invention is not dependent on use of any particular material.

It is possible to bend such a storm pane of a slightly flexible plastic, of uniform thickness from one edge to the other, into an arc of uniform curvature, to bring the edges together by a sufficient amount to permit them to be slipped into channels on opposite sides of the window opening. However, it is simpler to do this if a hinge line is provided in the middle of the pane.

Thus, as shown in FIGS. 2 and 3, the slightly flexible storm pane 35 is preferably formed with a groove 36 extending the entire length of the pane from one end to the other, in this case from top to bottom in the middle of the width of pane 35. The shape and dimensions of the groove will depend on the properties of the chosen material, but with a typical slightly flexible plastic pane, about 2 or 3 mm thick, a groove of a width about twice the thickness of the pane, reducing its thickness to one-third or one-fourth of the thickness of the remainder of the pane, will permit easy bending for placement of its edges in channels 27.

The elasticity of the plastic material of pane 35 will cause it to return spontaneously to approximately its original flat shape as the edges enter channels 27, but some plastics are not perfectly elastic and will require a push to straighten out the pane.

Such a push is easily provided by a suitable latching device. A latch is needed in any event to prevent strong winds from dislodging the pane, and to provide security against unauthorized opening from the outside.

Figure 11:
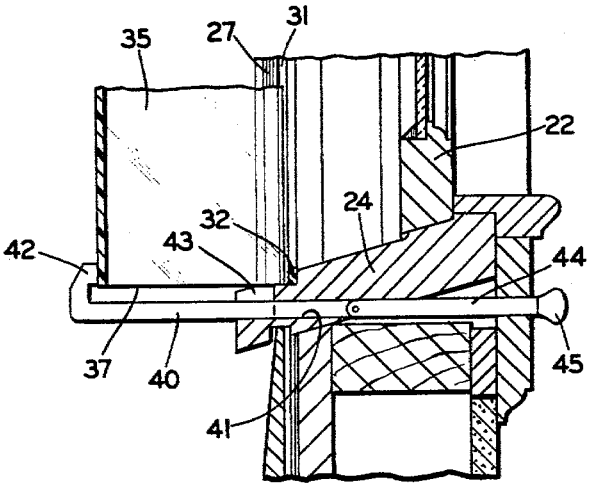
FIG. 11 is a vertical section showing a suitable form of latch, in its open position

A simple form of latch is shown in FIG. 11 and FIG. 12. It consists of a bar 40 sliding in a tunnel 41 extending from inside to outside of the window sill 24, with an integral upwardly extending finger 42 movable in a slot 43 in the outer portion of the sill. The inner end of bar 40 has hinged to it an extension bar 44 of the same cross-section size as bar 40 so that both can slide in tunnel 41, and with a knob or handle 45 at its end.

A similar latch is provided in the lintel 23 for holding the top edge of pane 35, as shown in FIG. 13, in which the bar 40 and its extension 44 suitably pass through the space between the window-frame and the header 47 above the window.

For releasing the pane from the window, each latch extension 44 is swung into alignment with bar 40 and the entire latch is pushed outward. The pane 35 can then be bent, from the inside, by pressing outward against the groove or hinge line 36 until the bottom edge 37 and top edge 38 are moved outward of the window past the sill and lintel, so that these edges can be gripped with the fingers and the pane can be released from channels 27.

The operation of installing the pane is the reverse. The latches are placed in their outermost position, the pane 35 is bent along its groove 36 and passed to the outside of the window, where it is turned upright with the bend at groove 36 outermost. One edge is started in one vertical channel 27 and the other edge is moved to its position in the other channel 27, while knob 45 is pulled inward to engage lower latch finger 42 with the pane 35. The upper latch is drawn into engagement in the same way. The knob 45 of each latch is then drawn further inward to straighten the bent pane 35 and force its vertical edges sidewards into channels 27 to engage sealing strips 31, and finally to press the faces next to bottom edge 37 and top edge 38 of the pane against sealing strips 32.

When latches 40 have been drawn fully inward, the hinged extensions 44 are turned downward to lock the latches in place.

The construction described above can be modified in various ways, as to the manner in which the parts of the storm pane can be moved with respect to one another, and also as to their relationship to the permanent window.

Thus, instead of hinging the storm pane by forming a thin zone, the pane can be made in two pieces joined by a tongue and groove joint. For example, as shown in FIG. 4 pane 50 can be half the width of the entire storm pane, with a tongue 51 molded or otherwise formed along all of one edge. The other half pane 52 is then formed with a corresponding groove 53 in the mating edge, so that the two portions when brought together can hinge with respect to one another for entry of the external vertical edges into channels 27 or for removal from the channels, as described above for the integral pane.

As a further alternative, the storm pane can be made in two halves connected by a ship-lap joint as shown in FIG. 5. In this construction, half pane 55 can have a rabbeted or stepped edge 56, and the other mating half pane 57 can have an oppositely directed rabbeted edge 58, so that the two half panes 55 and 57 can be brought together at a slight angle and then be drawn into an in-line position to seal firmly at the extreme edges against sealing strips 31, and form a tight labyrinth joint where they come together.

Moreover, almost any size and proportion of rectangular windows, and different relations of the storm panes to the window, are possible.

Thus, as shown in FIG. 6, the storm pane 60 can be designed to have its hinge line 61 horizontally across the window, which requires the channels 62,62 to extend horizontally across the top and bottom of the frame, and the outwardly facing seals to be on the vertical sides. The latches 63,63 then would also be on the vertical sides of the frame to engage the storm pane 60 at or about at the hinge line 61, as shown in more detail in FIGS. 6 and 14.

Figure 7:
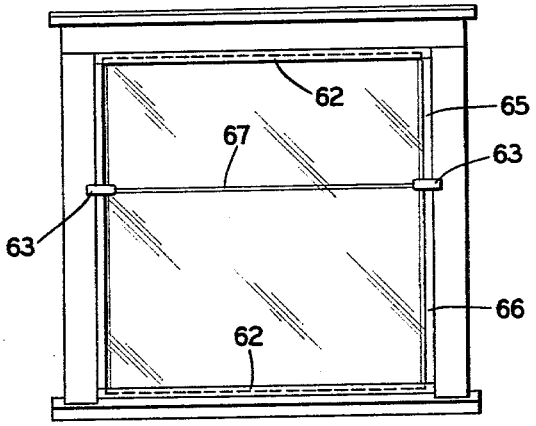
FIG. 7 is an elevation, on the smaller scale, of a storm window with its hinge nearer one edge than the other.
Figure 8:
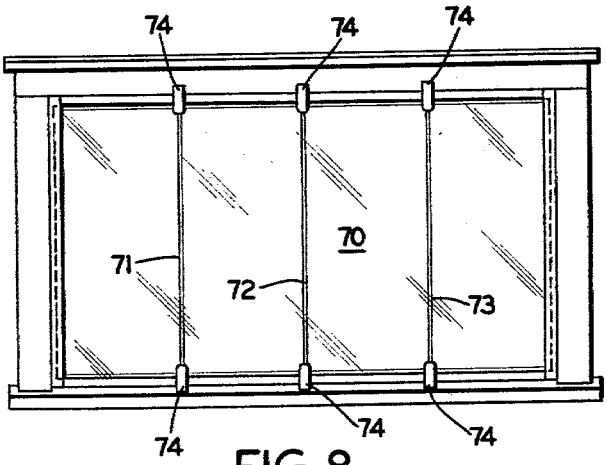
FIG. 8 is an elevation, on the smaller scale, of a storm window with more than one hinge line.

It is not important that the construction be absolutely symmetrical. Thus, as is sometimes the case, and as shown in FIG. 7, an upper sash 65 and a lower sash 66 may be of somewhat different height. In such a situation it may be found desirable to place the hinge line 67 of the storm pane at the same unsymmetrical level as the conjunction of the permanent sash, which would make the hinge line essentially invisible from the inside.

The storm pane of this invention is not limited to any particular size or proportion of window, except that it is most easily managed with rectangular window openings.

Figure 9:
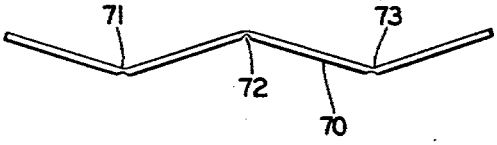
FIG. 9 is a plan view of the pane of FIG. 8 in its bent condition.

Consequently, rectangular windows of much greater dimensions in one direction than another can be equipped with the storm panes of this invention as shown in FIG. 9, in which the width is more than twice the height.

In such a wide installation, two or more storm panes can be installed side by side, or a single storm pane can be provided, having more than one hinge line. Thus, in FIGS. 9 and 10, the pane 70 has three hinge lines, the first hinge 71 bending with the hinge outward, the second hinge 72 bending with the hinge inward, and the third hinge 73 bending with the hinge outward, so that latches 74,74 are required for both hinge 71 and hinge 73.

In addition, it should be noted that placement of the hinge line horizontally has the advantage of location of the latches at the sides of the window, at or near the middle of the window height, which is generally the most convenient level for manipulation of a latch, and for placement of the operating handle. However, this presents the minor problem of providing for drainage of moisture or rainwater from the lower channel member.

Thus, as shown in FIG. 15, the outwardly facing seals 62, in this modification, are vertical, and the channels are horizontal. Accordingly, it will be preferred to make at least the lower channel 62 with a scalloped edge, with the dips of the scallops 68 low enough to provide for adequate drainage.

It is thus apparent that a very simple and easily managed, yet very effective and versatile storm window has been provided, which eliminates the expense, and the weight, and the awkwardness of rigid frames on removable storm windows, yet provides a combination of a tight seal against drafts, and added security against entry through the windows.

I claim:

1. A removable storm pane for use in a rectangular window opening closed by a sash, the storm pane consisting of panels of impervious stiff sheet material disposed with edges adjoining, and with the panels hinging between two positions, one position having the plane of one panel at a small angle to the plane of another panel with an overall dimension transverse to both panels small enough to permit insertion in and removal from a window opening, and the other position having the panels in a single plane with their overall dimensions being those required to provide a second closure in the window opening.

2. A storm pane as in claim 1 in which the pane is one integral piece and the panels are connected by a thinned zone about which one panel can be swung relative to another panel.

3. A storm pane as in claim 1 in which the pane consists of separable panels having adjoining edges which interfit to form a wind-tight hinging joint.

4. A storm pane as in claim 3 in which the interfitting edges have a tongue and groove configuration.

5. A storm pane as in claim 3 in which the interfitting edges have a ship-lap configuration.

6. The combination of a window having sash in a rectangular window opening, and a removable storm pane, characterized in that the storm pane is composed of impervious stiff sheet material and is changeable from a plane configuration dimensioned to stop the window opening and a bent configuration in which the distance between two opposite edges is reduced for placement in and removal from the window opening, and that the window opening is provided with means for engaging and holding the said opposite edges against movement outward of the window opening.

7. The combination as in claim 6, in which resilient seals are present between the window opening and the margins of the storm pane.

8. The combination as in claim 7, including clamps for pressing margins of the storm pane in the direction inward of the window against resilient seals.

9. The combination as in claim 8 in which the clamps are operable from within the window and include mechanism for locking the clamps against outward motion.

10. The combination as in claim 7, including a pair of resilient sealing strips as long as a pair of opposing edges of the storm pane and with their sealing faces spaced apart by a distance slightly less than the dimension between the opposing edges when the storm pane is in a single plane.

* * * * *